US007910278B2

(12) United States Patent
Ohta et al.

(10) Patent No.: US 7,910,278 B2
(45) Date of Patent: Mar. 22, 2011

(54) TONER FOR DEVELOPING ELECTROSTATIC IMAGE

(75) Inventors: Gen-ichi Ohta, Tokyo (JP); Hiroto Kidokoro, Tokyo (JP)

(73) Assignee: Zeon Corporation, Tokyo (JP)

( * ) Notice: Subject to any disclaimer, the term of this patent is extended or adjusted under 35 U.S.C. 154(b) by 943 days.

(21) Appl. No.: 11/793,658

(22) PCT Filed: Dec. 28, 2005

(86) PCT No.: PCT/JP2005/024071

§ 371 (c)(1),
(2), (4) Date: Jun. 21, 2007

(87) PCT Pub. No.: WO2006/070870

PCT Pub. Date: Jul. 6, 2006

(65) Prior Publication Data

US 2007/0269733 A1 Nov. 22, 2007

(30) Foreign Application Priority Data

Dec. 28, 2004 (JP) ..... 2004-382119

(51) Int. Cl.
*G03G 9/00* (2006.01)

(52) U.S. Cl. ..... 430/111.41; 430/125.3

(58) Field of Classification Search ..... 430/111.41, 430/125.3

See application file for complete search history.

(56) References Cited

U.S. PATENT DOCUMENTS

| | | | | |
|---|---|---|---|---|
| 6,613,490 | B2 * | 9/2003 | Matsunaga et al. | 430/109.3 |
| 7,026,086 | B2 * | 4/2006 | Kashiwabara et al. | 430/108.4 |
| 2003/0044708 | A1 * | 3/2003 | Matsunaga et al. | 430/108.22 |

FOREIGN PATENT DOCUMENTS

| | | | |
|---|---|---|---|
| JP | 5-100477 | | 4/1993 |
| JP | 9-106093 | | 4/1997 |
| JP | 10-171156 | | 6/1998 |
| JP | 2000-131877 | A | 5/2000 |
| JP | 2001-075305 | A | 3/2001 |
| JP | 2001-305779 | | 11/2001 |
| JP | 2004-151638 | | 5/2004 |
| JP | 2004-198692 | | 7/2004 |

OTHER PUBLICATIONS

Japanese Office Action dated Sep. 21, 2010, issued in corresponding Japanese Patent Application No. 2006-550845.

* cited by examiner

*Primary Examiner* — Mark A Chapman
(74) *Attorney, Agent, or Firm* — Westerman, Hattori, Daniels & Adrian, LLP

(57) ABSTRACT

The present invention provides a toner for developing electrostatic image comprising a colored particle containing a binder resin, a colorant and a release agent, wherein the toner for developing electrostatic image has two or more peaks of loss tangent (tan δ) in the range from 50 to 120° C., a loss tangent (tan δ) in the range from 100 to 200° C. is 0.8 or less, and a dispersed diameter of the release agent is 0.1 times or less shorter than a volume average particle diameter of the colored particle.

8 Claims, 1 Drawing Sheet

TONER FOR DEVELOPING ELECTROSTATIC IMAGE

TECHNICAL FIELD

The present invention relates to a toner for developing electrostatic to be used in electrophotography, electrostatic recording, electrostatic printing, magnetic recording, and the like for developing latent images having electrostatic properties, such as an electrostatic latent image and a magnetic latent image. Particularly, the present invention relates to a toner for developing electrostatic image (hereinafter, also simply referred to as a "toner") suitable for use in a heat-pressure fixing system such as heat roller fixing or the like.

BACKGROUND ART

Electrophotography is a technique for obtaining images by developing an electrostatic latent image formed on a photosensitive member with a toner for developing electrostatic latent image comprising a colored particle and, if necessary, one or more kinds of other particles such as an external additive and/or a carrier, transferring the toner onto a recording medium such as paper or an OHP sheet, and fixing the transferred toner onto the recording medium so as to obtain a printed product.

In the case of full-color electrophotography, colors are generally reproduced using three color toners of primary colors, yellow, magenta, and cyan or four color toners of these three colors and black to form color images. For example, in the case of color copy, an original color document is scanned, broken into a plurality of pixels, and converted into digital image signals for different colors, and then a charged photosensitive member is irradiated with light corresponding to the digital image signal for each color to form an electrostatic latent image. Then, the electrostatic latent image for a first color is developed with a toner of the first color on the photosensitive member, and a resulting toner image is transferred onto a recording medium such as paper or an OHP film. These developing and transfer steps are repeated for a second color, a third color, and, if necessary, a fourth color to superimpose color images on top of each other on the same recording medium while these color images are adjusted to their respective correct positions. In the case of color printing, digital signals for four colors are directly transmitted from, for example, a computer to a photosensitive member to separately form electrostatic latent images for four different colors. Then, development is carried out for each color and a resulting toner image is transferred onto a recording medium in the same manner as in the case of color copy. After the completion of development with all the four color toners and transfer, the toner images of four colors are fixed onto the recording medium by one-time fixing to form a full-color image.

Known methods for fixing toner images include heating, pressing, heating and pressing, and exposure to solvent vapor. Among them, a heating and pressing method using a heat roller is most widely used.

Here, in the field of such electrophotography, particularly in color electrophotography using two or more color toners, there is a strong demand for higher printing speed and lower energy for fixing. Therefore, a toner is required to have a low minimum fixing temperature and a high hot offset generation temperature. In addition, sharpness of an image formed at a higher printing speed with lower fixing energy is of growing importance.

It is generally known that a reduction in the glass transition temperature or melt viscosity of a toner is effective at lowering its minimum fixing temperature.

However, such a method may cause the following various problems: (1) the shelf stability of a toner is impaired; (2) a toner remaining on a photosensitive member forms a thin film, that is, filming occurs; (3) the maximum number of sheets that can be printed is reduced due to the occurrence of fog or filming and the printing durability of a toner is reduced; and (4) a hot offset phenomenon (hereinafter, simply referred to as "hot offset") occurs at low temperature so that part of a toner forming a toner image transferred onto a recording medium is attached to a heat roller and is then again transferred onto a subsequent recording medium.

Such hot offset is conventionally prevented by applying silicone oil onto a fixing roller.

However, such a method makes it difficult to reduce the size and price of a fixing unit (e.g. an image-forming apparatus). In addition, there is also a problem that an obtained image is too glossy.

In recent years, from the viewpoint of improving the low-temperature fixability of a toner and preventing the occurrence of hot offset, toner has been studied by focusing attention on its viscoelasticity.

For example, Japanese Patent Application Laid-Open (JP-A) No. 2004-151638 discloses a color toner for developing electrostatic image, which is designed to have excellent low-temperature fixability, high resistance to hot offset and excellent shelf stability. This color toner for developing electrostatic image comprises at least a binder resin, a colorant, and a charge control agent, and has the following dynamic viscoelastic characteristics as measured at a frequency of 10 Hz and a strain of 1%: a storage modulus at 80° C. (G'80) from $5\times10^6$ to $5\times10^8$ Pa; a storage modulus at 160° C. (G'160) from $1\times10^2$ to $1\times10^4$ Pa; a maximum value of loss tangent (tan δ) from 1.2 to 2.5 in the range from 80 to 100° C.; and a minimum value of tan δ of 1 to 2 in the range from 95 to 125° C., and further has a volume average particle diameter (Dv) from 2 to 11 μm, and a ratio between volume average particle diameter (Dv) and number average particle diameter (Dp) (i.e. Dv/Dp) of 1.3 or less.

Further, JP-A No. Hei. 5-100477 discloses a toner designed to have excellent low-temperature fixability and offers resistance to offset over a wide temperature range. The toner comprises at least a binder resin having, as dynamic viscoelastic behaviors, a dynamic loss G" at 150° C. of $1\times10^5$ dyn/cm$^2$ or less and a dynamic modulus G' at 200° C. of $2\times10^4$ dyn/cm$^2$ or more and a release agent having a melt viscosity at 140° C. from 5 to 100 cps, and has a loss tangent (tan δ) in the range from 150 to 200° C. from 0.05 to 1.0.

DISCLOSURE OF THE INVENTION

These toners disclosed in JP-A No. 2004-151638 and JP-A No. Hei. 5-100477 have improved low-temperature fixability and resistance to hot offset (i.e. a higher hot offset generation temperature). However, there is still a demand for further improvement in low-temperature fixability and resistance to hot offset. In addition, there is also a demand for improvement in not only low-temperature fixability and resistance to hot offset but also other various properties.

It is therefore an object of the present invention to provide a toner for developing electrostatic image which shows excellent fixability over a wide temperature range including a low temperature range, has high resistance to hot offset, and is further excellent in shelf stability, cleaning properties on a photosensitive member, and printing durability.

In order to achieve the above object, the present inventors have made an extensive study, and as a result found that the above object can be achieved by a toner which comprises a toner particle containing a release agent finely dispersed therein, and which has a specific loss tangent-temperature relationship.

Based on the above findings, the present invention is directed to a toner for developing electrostatic image comprising a colored particle containing a binder resin, a colorant and a release agent, wherein the toner for developing electrostatic image has two or more maximum values of peaks or shoulders of loss tangent (tan δ) in the range from 50 to 120° C., a loss tangent (tan δ) in the range from 100 to 200° C. is 0.8 or less, and a dispersed diameter of the release agent is 0.1 times or less shorter than a volume average particle diameter of the colored particle.

It is preferable that the toner for developing electrostatic image has a ratio of a loss tangent at 150° C. (tan δ (150° C.)) and a loss tangent at 200° C. (tan δ (200° C.) (i.e., tan δ (200° C.)/tan δ (150° C.)) of 1.2 or more.

It is also preferable that the shape factors SF-1 and SF-2 of the colored particle in the toner for developing electrostatic image are 130≦SF-1≦170 and 110≦SF-2≦150.

It is also preferable that the toner for developing electrostatic image is produced by a polymerization method.

It is also preferable that a volume average particle diameter (Dv) of the colored particle is in the range from 4 to 10 μm.

It is also preferable that the release agent is a multifunctional ester compound.

Another aspect of the present invention is directed to an image-forming method comprising steps of: a developing process to form a visible image with the above-described toner for developing electrostatic image on a photosensitive member; a transferring process to form a transferred image by transferring the visible image on a recording medium; and a fixing process to fix the transferred image.

The toner according to the present invention shows excellent fixability over a wide temperature range including a low temperature range, has high resistance to hot offset, and is further excellent in shelf stability, cleaning properties on a photosensitive member, and printing durability.

BRIEF DESCRIPTION OF THE DRAWINGS

In the accompanying drawings.

Figure 1:
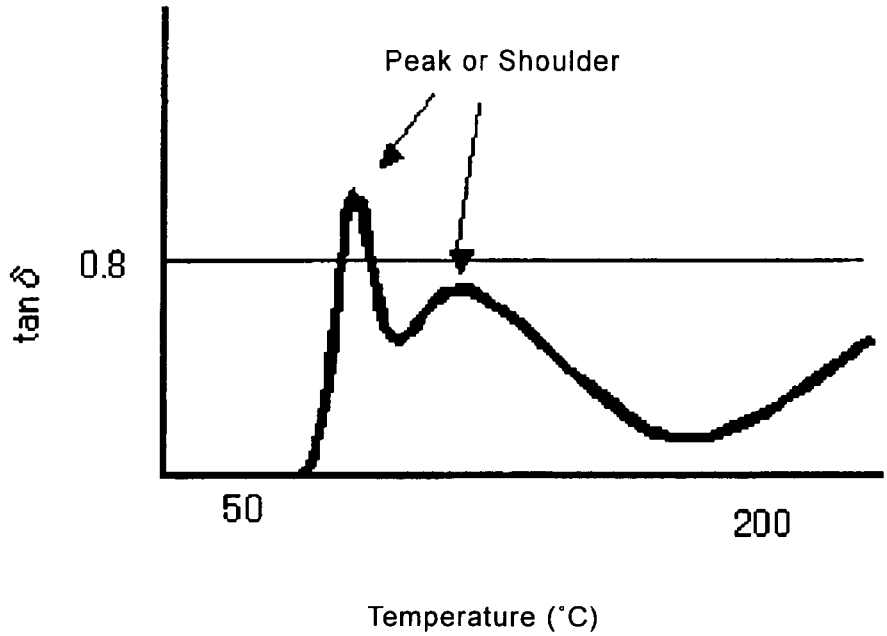
FIG. 1 is a graph which shows one example of the relationship between the loss tangent (tan δ) of a toner according to the present invention and temperature.

The sign in each figure refers to the following: 1: photosensitive drum, 5: charging roller, 9: transfer roller, 7: light irradiation device, 11: recording medium, 13: developing roller, 15: blade for the developing roller, 17: supply roller, 18: stirring vane, 19: toner, 21: developing device, 23: casing, 23*a*: toner vessel, 25: cleaning blade, 27: fixing device, 27*a*: heat roller, and 27*b*: support roller.

BEST MODE FOR CARRYING OUT THE INVENTION

Hereinbelow, a toner for developing electrostatic image according to the present invention will be described.

The toner for developing electrostatic image according to the present invention comprises a colored particle containing a binder resin, a colorant and a release agent, and has two or more maximum values of peaks or shoulders of loss tangent (tan δ) in the range from 50 to 120° C. and a loss tangent (tan δ) in the range from 100 to 200° C. of 0.8 or less, wherein a dispersed diameter of the release agent is 0.1 times or less shorter than a volume average particle diameter of the colored particle.

In the present invention, the term "peak" refers to a region from the leading to trailing edge of a mountain-shaped curve having a maximum value, and the term "shoulder" refers to an incomplete peak which is not completely separated from the peak, that is, a stepped portion appearing in the peak region and having a maximum value.

The toner for developing electrostatic image of the present invention comprises a colored particle, and if necessary, the toner may further comprise one or more kinds of other particles or components such as an external additive to be attached to the surface of the colored particle and/or a carrier particle for carrying the colored particle.

The colored particle in the toner contains at least a binder resin, a colorant and a release agent, and if necessary, the colored particle may further contain one or more other components such as a charge control agent or the like.

As the binder resin contained in the colored particle include resins conventionally used as a binder resin for toner. For example, there may be styrene such as polystyrene, polyvinyl toluene or the like, and a polymer of derivative substitution thereof; a styrene copolymer such as a styrene-methyl acrylate copolymer, a styrene-ethyl acrylate copolymer, a styrene-butyl acrylate copolymer, a styrene-2-ethylhexyl acrylate copolymer, a styrene-methyl methacrylate copolymer, a styrene-ethyl methacrylate copolymer, a styrene-butyl methacrylate copolymer, a styrene-butadiene copolymer or the like; polymethyl methacrylate, polyester, an epoxy resin, polyvinyl butyral, an aliphatic or alicyclic hydrocarbon resin, polyolefin, a (meth)acrylate resin, a norbornene-based resin and a hydrogenated product of the styrene-based resin.

Examples of the colorant include various pigments and dyes such as carbon black, titanium black, magnetic powders (magnetic materials), oil black, titanium white or the like.

In the case of producing a black toner, carbon black may be preferably used. A primary particle diameter of carbon black which is suitably used is 20 to 40 nm. By using colorant having such a primary particle diameter, it is possible to uniformly disperse the carbon black in the toner, thereby suppressing the occurrence of fog.

In the case of producing a full-color toner, a yellow colorant, a magenta colorant and a cyan colorant are usually used.

As the yellow colorant, a compound such as an azo-based pigment, a condensed polycyclic pigment or the like may be used. Specific examples of such a yellow colorant include C.I. Pigment Yellow 3, 12, 13, 14, 15, 17, 62, 65, 73, 74, 75, 83, 90, 93, 97, 120, 138, 155, 180, 181, 185, 186 and so on.

As the magenta colorant, a compound such as an azo-based pigment, a condensed polycyclic pigment or the like may be used. Specific examples of such a magenta colorant include C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209, and 251, C.I. Pigment Violet 19 and so on.

As the cyan colorant, a phthalocyanine compound such as a copper phthalocyanine compound or a derivative thereof, an anthraquinone compound or the like may be used. Specific examples of such a cyan colorant include C.I. Pigment Blue 2, 3, 6, 15, 15:1, 15:2, 15:3, 15:4, 16, 17, 60 and so on.

The amount of each of the colorants to be used is preferably 1 to 10 parts by weight with respect to 100 parts by weight of the binder resin.

Examples of the magnetic materials include iron oxides such as magnetite, γ-iron oxide, ferrite, iron-excess ferrite or the like; iron, cobalt or nickel, or alloys thereof with one or more of aluminum, cobalt, copper, lead, magnesium, tin, zinc, antimony, beryllium, bismuth, cadmium, calcium, manganese, selenium, titanium, tungsten and vanadium, or mixtures thereof.

The magnetic material is usually used in an amount from 10 to 60 parts by weight, preferably 20 to 50 parts by weight, with respect to 100 parts by weight of the binder resin.

Examples of the release agent include: polyolefin waxes such as low-molecular weight polyethylene, low-molecular weight polypropylene, low-molecular weight polybutylene or the like; natural waxes such as candelilla wax, carnauba wax, rice wax, Japan wax, jojoba wax or the like; petroleum waxes such as paraffin, microcrystalline, petrolatum or the like and modified waxes thereof; synthetic waxes such as Fischer-Tropsch wax or the like; and multifunctional ester compounds such as pentaerythritol tetramyristate, pentaerythritol tetrastearate, pentaerythritol tetrapalmitate, dipentaerythritol hexamyristate, dipentaerythritol hexastearate or the like.

These release agents can be used alone or in combination of two or more kinds.

Among these release agents, synthetic waxes and multifunctional ester compounds are preferably used. Among them, from the viewpoint of obtaining a toner offering an excellent balance between fixability and releasability upon fixing, multifunctional ester compounds whose endothermic peak temperature during temperature rise in a DSC curve measured using a differential scanning calorimeter is preferably in the range from 30 to 150° C., more preferably in the range from 40 to 100° C., most preferably in the range from 50 to 80° C., are preferably used. Particularly, multifunctional ester compounds having a molecular weight of 1,000 or more, being soluble in styrene in an amount of 5 parts by weight or more with respect to 100 parts by weight of styrene at 25° C., and having an acid value of 10 mgKOH/g or less are more preferably used because such a multifunctional ester compounds have a significant effect on lowering the minimum fixing temperature. Herein, the term "endothermic peak temperature" means a value measured in accordance with ASTM D3418-82.

In the present invention, the dispersed diameter of the release agent is 0.1 times or less shorter than the volume average particle diameter of the colored particle. The release agent may be so finely dispersed in the colored particle that the existence thereof cannot or can hardly be recognized with a transmission electron microscope (TEM) It is to be noted that a state where the release agent is finely dispersed in the colored particle includes a state where the release agent and the binder resin contained in the colored particle are mutually dissolved.

If the dispersed diameter of the release agent exceeds 0.1 times the volume average particle diameter of the colored particle, there is a fear that bleeding may occur during high-temperature storage, thereby impairing shelf stability and causing poor printing.

The term "dispersed diameter of the release agent" herein refers to a dispersed diameter of the release agent as measured in the following manner. The toner is dispersed in an epoxy resin, cured, cooled to a temperature of −80° C., and cut with a microtome to prepare a thin slice. The thin slice is stained with a vapor of 0.5% aqueous solution of ruthenium tetroxide for about 5 minutes, and then the stained thin slice is observed with a TEM (transmission electron microscope) (magnification: ×5,000 to ×6,000).

The concentration of the toner in a sample obtained by dispersing the toner in an epoxy resin is adjusted so that 5 to 10 cross-sections of the colored particles can be observed in a TEM image covering an area of 28×35 μm. Among the colored particles observed in the TEM image covering an area of 28×35 μm, one whose cross-section is not entirely shown and one whose cross-sectional size is not 0.6 to 1.2 times the volume average particle diameter of the colored particle are excluded from evaluation. The cross-sections of the colored particles other than such colored particles excluded from evaluation are observed on the TEM screen to determine the diameters of island-shaped separate phases of the release agent. The average diameter of the island-shaped separate phases is defined as a dispersed diameter of the release agent.

The release agent is usually used in an amount from 0.5 to 50 parts by weight, preferably 1 to 20 parts by weight, with respect to 100 parts by weight of the binder resin.

The colored particle preferably contains a charge control agent. The charge control agent is not particularly limited, and examples thereof include charge control agents conventionally used for toner. Among these charge control agents, charge control resins are preferably used because they are highly compatible with binder resins and colorless, and make it possible to provide a toner whose charge property is stable even at high-speed color continuous printing.

Such charge control resins include a negative charge control resin and a positive charge control resin, and which one is used depends on whether the toner according to the present invention is prepared as a positively chargeable toner or a negatively chargeable toner. Hereinbelow, the negative charge control resin and the positive charge control resin will be described.

Examples of the negative charge control resin include resins having, in the side chain of a polymer, a substituent selected from the group consisting of a carboxyl group or a salt thereof, a phenol group or a salt thereof, a thiophenol group or a salt thereof, a sulfonic acid group or a salt thereof.

Among these negative charge control resins, resins having, in the side chain of a polymer, a sulfonic acid group or a salt thereof are preferably used. Specific examples of such a negative charge control resin include resins obtained by copolymerizing a monovinyl monomer containing a sulfonic acid group or a salt thereof and another monovinyl monomer copolymerizable with the monovinyl monomer containing a sulfonic acid group or a salt thereof. Examples of another monovinyl monomer copolymerizable with a monovinyl monomer containing a sulfonic acid group or a salt thereof include ethylenically unsaturated carboxylic acid ester monomers, aromatic vinyl monomers, ethylenically unsaturated nitrile monomers and so on.

Examples of the monovinyl monomer containing a sulfonic acid group or a salt thereof include styrene sulfonic acid, sodium styrene sulfonate, potassium styrene sulfonate, 2-acrylamido-2-methylpropanesulfonic acid, sodium vinyl sulfonate, ammonium methacryl sulfonate or the like.

Examples of the ethylenically unsaturated carboxylic acid ester monomer include methyl(meth)acrylate, ethyl (meth) acrylate, propyl(meth)acrylate, butyl (meth)acrylate, 2-ethylhexyl(meth)acrylate or the like. The term "(meth)acrylate" refers to either acrylate or methacrylate.

Examples of the aromatic vinyl monomer include styrene, methyl styrene, vinyl toluene, chlorostyrene, hydroxymethyl styrene or the like.

Examples of the ethylenically unsaturated nitrile monomer include (meth)acrylonitrile, fumaronitrile, α-chloroacrylonitrile, α-cyanoethylacrylonitrile or the like.

An amount of the monovinyl monomer containing a functional group such as a sulfonic acid group or a salt thereof in the negative charge control resin is preferably in the range from 0.5 to 15 wt %, more preferably in the range from 1 to 10 wt %. If the amount of such a monovinyl monomer contained in the negative charge control resin is less than the above lower limit value, the charge property of the toner and the dispersibility of the colorant may be poor, thereby lowering printing density and transparency. If the amount of such a monovinyl monomer contained in the negative charge control resin exceeds the above upper limit value, a reduction in the charge amount of the toner under high-temperature and high-humidity conditions may be increased, thereby causing fog.

The weight average molecular weight of the negative charge control resin is preferably in the range from 2,000 to 50,000, more preferably in the range from 4,000 to 40,000, most preferably in the range from 6,000 to 35,000.

The glass transition temperature of the negative charge control resin is preferably in the range from 40 to 80° C., more preferably in the range from 45 to 75° C., most preferably in the range from 45 to 70° C. If the glass transition temperature of the negative charge control resin is less than the above lower limit value, the shelf stability of the toner may be impaired. If the glass transition temperature of the negative charge control resin exceeds the above upper limit value, the fixability of the toner may be deteriorated.

Examples of the positive charge control resin include: resins containing an amino group such as $—NH_2$, $—NHCH_3$, $—N(CH_3)_2$, $—NHC_2H_5$, $—N(C_2H_5)_2$, $—NHC_2H_4OH$ or the like; and resins containing, as a functional group, an ammonium salt of the above-mentioned amino group. These resins can be obtained by, for example, copolymerizing a monovinyl monomer containing an amino group with a monovinyl monomer copolymerizable with the monovinyl monomer containing an amino group. Thus obtained copolymer may be modified to obtain an ammonium salt thereof. Alternatively, these resins may also be obtained by copolymerizing a monovinyl monomer containing an ammonium salt group with a monovinyl monomer copolymerizable with the monovinyl monomer containing an ammonium salt group. However, a method for obtaining a positive charge control resin is not limited to these methods. Examples of the monovinyl monomer copolymerizable with a monovinyl monomer containing an amino group and the monovinyl monomer copolymerizable with a monovinyl monomer containing an ammonium salt group include those used for obtaining a negative charge control resin.

Examples of the monovinyl monomer containing an amino group include: alkyl(meth)acrylamide monomers such as (meth)acrylamide, N-methyl(meth)acrylamide, N,N-dimethyl(meth)acrylamide, N-ethyl(meth)acrylamide or the like; (meth)acrylic acid derivatives such as 3-(dimethylamino)propyl(meth)acrylate; allylamine or the like; and styrene derivatives such as 2-aminostyrene, 4-aminostyrene or the like.

An amount of the monovinyl monomer, having a functional group such as an amino group, an ammonium salt group or the like, contained in the positive charge control resin is preferably in the range from 0.5 to 15 wt %, more preferably in the range from 1 to 10 wt %. If the amount of the monovinyl monomer, having a functional group such as an amino group or an ammonium salt group, contained in the positive charge control resin is less than the above lower limit value, the charge property of the toner and the dispersibility of the colorant may be poor, thereby lowering printing density and transparency. If the amount of the monovinyl monomer, having a functional group such as an amino group or an ammonium salt group, contained in the positive charge control resin exceeds the above upper limit value, a reduction in the charge amount of the toner under high-temperature and high-humidity conditions may be increased, thereby causing fog.

The weight average molecular weight of the positive charge control resin is preferably in the range from 2,000 to 30,000, more preferably in the range from 4,000 to 25,000, most preferably in the range from 6,000 to 20,000.

The glass transition temperature of the positive charge control resin is preferably in the range from 40 to 100° C., more preferably in the range from 45 to 80° C., most preferably in the range from 45 to 70° C. If the glass transition temperature of the positive charge control resin is less than the above lower limit value, the shelf stability of the toner may be impaired. If the glass transition temperature of the positive charge control resin exceeds the above upper limit value, the fixability of the toner may be deteriorated.

In the toner of the present invention, the negative charge control resin and the positive charge control resin may be used together, and the ratio between the amounts of these resins to be used varies depending on whether the toner is prepared as a negatively chargeable toner or a positively chargeable toner. In the case of producing a negatively chargeable toner, the ratio between the amounts of the negative and positive charge control resins to be used is controlled so that the molar equivalent of a functional group (e.g. a sulfonic acid group) contained in the negative charge control resin to provide negatively charging ability is larger than that of a functional group (e.g. a quaternary ammonium salt group) contained in the positive charge control resin to provide positively charging ability. Conversely, in the case of producing a positively chargeable toner, the ratio between the amounts of the negative and positive charge control resins to be used is controlled so that the molar equivalent of a functional group contained in the positive charge control resin is larger than that of a functional group contained in the negative charge control resin.

An amount of the charge control resin to be used is preferably in the range from 0.01 to 30 parts by weight, more preferably in the range from 0.3 to 25 parts by weight, with respect to 100 parts by weight of the polymerizable monomer to be used for obtaining a binder resin.

The colored particle may be a so-called core-shell structured particle obtained by using two different polymers for forming an inner part (i.e. a core layer) of the particle and an outer part (i.e. a shell layer) of the toner, respectively. A core-shell structured particle obtained by covering an inner part (i.e. a core layer) made of a substance having a low softening point with a substance having a softening point higher than that of the inner part is preferably used because such a core-shell structured particle can strike a balance between the low-temperature fixability and the shelf stability of the toner.

The core layer of the core-shell structured particle usually comprises the binder resin, colorant and release agent, and if necessary the charge control resin and/or one or more other additives. On the other hand, the shell layer is usually composed of only a binder resin.

In the case of the core-shell structured particle, the glass transition temperature of a polymer constituting the core layer is preferably in the range from 0 to 80° C., more preferably in the range from 40 to 60° C. If the glass transition temperature of the polymer exceeds 80° C., the minimum fixing temperature of the toner may be increased. On the other hand, if the glass transition temperature of the polymer is less than 0° C., the shelf stability of the toner may be impaired.

It is necessary to set the glass transition temperature of a polymer constituting the shell layer to be higher than that of the polymer constituting the core layer. From the view point of improving the shelf stability of the toner, the glass transition temperature of a polymer constituting the shell layer is preferably in the range from 50 to 130° C., more preferably in the range from 60 to 120° C., most preferably in the range from 80 to 110° C. If the glass transition temperature of the polymer is less than the above lower limit value, the shelf stability of the toner may be impaired. On the other hand, if the glass transition temperature of the polymer exceeds the above upper limit value, the fixability of the toner may be deteriorated.

The difference in the glass transition temperature between the polymer constituting the core layer and the polymer constituting the shell layer is preferably 10° C. or more, more preferably 20° C. or more, most preferably 30° C. or more. If the difference in the glass transition temperature between these polymers is less than the above lower limit value, a balance between the shelf stability and the fixability of the toner may be decreased.

The weight ratio between the core layer and the shell layer of the core-shell structured particle is not particularly limited, but is preferably in the range from 80/20 to 99.9/0.1 (core layer/shell layer). If the weight ratio of the shell layer is less than the above lower limit value, the shelf stability of the toner may be impaired. To the contrary, if the weight ratio of the shell layer exceeds the above upper limit value, low-temperature fixing may be difficult to be carried out.

The average thickness of the shell layer of the core-shell structured particle is usually in the range from 0.001 to 1.0 μm, preferably in the range from 0.003 to 0.5 μm, more preferably in the range from 0.005 to 0.2 μm. If the average thickness of the shell layer exceeds the above upper limit value, the fixability of the toner may be deteriorated. If the average thickness of the shell layer is less than the above lower limit value, the shelf stability of the toner may be impaired.

When the core layer and the shell layer of the core-shell structured particle can be observed with an electron microscope, the particle diameter of the core layer and the thickness of the shell layer can be determined by randomly selecting a core-shell structured particle in an electron micrograph and directly measuring the size of the core layer particle and the thickness of the shell layer of the core-shell structured particle. On the other hand, when it is difficult to observe the core layer particle and the shell layer with an electron microscope, the thickness of the shell layer can be determined by calculating from the particle diameter of the core layer and the amount of a polymerizable monomer for shell used for forming the toner.

The volume average particle diameter (Dv) of the colored particle is preferably in the range from 4 to 10 μm, more preferably in the range from 5 to 8 μm. If the Dv is less than 4 μm, the toner may leak from a sealing portion to make the inside of an image-forming apparatus dirty, the flowability of the toner may be deteriorated so that fog may occur, the toner may remain with inferior transferability, or the cleaning property of the toner may be lowered. On the other hand, if the Dv exceeds 10 μm, thin line reproducibility may be lowered and therefore high image quality may not be able to be achieved, or fixability of the toner may be deteriorated.

The colored particle usually has a ratio between its volume average particle diameter (Dv) and number average particle diameter (Dp) (i.e. Dv/Dp) from 1 to 1.3, preferably 1 to 1.2. If the Dv/Dp exceeds the above upper limit value, transferability may be deteriorated, fog may occur, or the production yield of the toner may be lowered.

The shape factors SF-1 and SF-2 of the colored particle are preferably $130 \leqq \text{SF-1} \leqq 170$ and $110 \leqq \text{SF-2} \leqq 150$, respectively, from the viewpoint of achieving excellent transferability and cleaning property.

In the present invention, the shape factors SF-1 and SF-2 are defined by the following formulas:

$$(\text{SF-1}) = (L_{MAX}^2/S) \times (\pi/4) \times 100$$

$$(\text{SF-2}) = (R^2/S) \times (1/4\pi) \times 100$$

wherein, $L_{MAX}$ is an absolute maximum length of a projected image, S is a projected area of the projected image, and R is a length of perimeter of the projected image.

Of these shape factors SF-1 and SF-2, SF-1 represents the degree of distortion of the whole particle, and SF-2 represents the degree of unevenness of a small part of the particle. It is to be noted that in the present invention, when an external additive is attached to the surface of the colored particle, the shape factor of the colored particle can be determined based on a projected image of the colored particle to which an external additive is attached. In the case of a two-component toner, a shape factor is determined based on a projected image of a colored particle contained in the toner.

The toner of the present invention may contain an external additive. By adhering or embedding an external additive to or in the surface of the colored particle, it is possible to control the charge property, flowability, and shelf stability of the colored particle.

Such an external additive is not particularly limited, and examples thereof include external additives conventionally used for a toner, such as inorganic particles and organic resin particles. Specific examples of the inorganic particles include silica, aluminum oxide, titanium oxide, zinc oxide and tin oxide. Specific examples of the organic resin particles include (meth)acrylic acid ester polymer particles, styrene-(meth) acrylic acid ester copolymer particles or the like. Among these external additives, silica or titanium oxide is suitably used. These particles whose surface has been subject to hydrophobicity-imparting treatment are preferably used, and silica particles subject to hydrophobicity-imparting treatment are particularly preferably used.

An amount of the external additive is not particularly limited, but is usually in the range from 0.1 to 6 parts by weight with respect to 100 parts by weight of the colored particle. The external additive can be used in combination of two or more kinds. In the case of using two or more kinds together, a combination of inorganic particles having different average particle diameters or a combination of an inorganic particle and an organic resin particle is suitable. Adhesion of the external additive to the toner particles is usually achieved by mixing the external additive and the colored particles in a mixer such as HENSCHEL MIXER (trade name) or the like.

In a case where the toner of the present invention is prepared as a two-component toner, the toner contains a carrier. The carrier for carrying the colored particle is not particularly limited, and examples thereof include carriers conventionally used for toner, such as magnetic powders (e.g. iron powder, ferrite powder or nickel powder), glass beads, and these carriers whose surfaces have been treated with a fluorine-based resin, a styrene/acrylic resin or a silicon-based resin and so on.

In the case of the two-component toner, the concentration of the colored particle in the toner is usually in the range from 0.1 to 50 wt %, preferably in the range from 0.5 to 15 wt %, more preferably in the range from 3 to 5 wt %.

The toner of the present invention has two or more maximum values of peaks or shoulders of loss tangent (tan δ) in the range from 50 to 120° C., preferably in the range from 55 to 100° C., more preferably in the range from 60 to 95° C., and has a loss tangent (tan δ) in the range from 100 to 200° C. of 0.8 or less. FIG. 1 shows an example of such a loss tangent (tan δ).

The toner having two or more maximum values of peaks or shoulders of loss tangent (tan δ) in the range from 50 to 120° C. and a loss tangent (tan δ) in the range from 100 to 200° C. of 0.8 or less has excellent low-temperature fixability and a high hot offset generation temperature. Therefore, even when such a toner is used for printing a large number of sheets, filming is less likely to occur, and the toner exhibits excellent printing durability.

The toner preferably has a ratio between a loss tangent at 150° C. (tan δ (150° C.)) and a loss tangent at 200° C. (tan δ (200° C.)) (i.e. tan δ (200° C.)/tan δ (150° C.)) of 1.2 or more because the above-described effects of the toner are further enhanced.

It is to be noted that the loss tangent (tan δ) of the toner is the ratio between a loss modulus (G") and a storage modulus (G') (i.e. G"/G') representing the viscoelastic properties of the toner.

The viscoelastic properties such as loss modulus (G") and storage modulus (G') can be measured using an instrument such as a viscoelasticity measuring instrument (rheometer) (product name: RDA-II; manufactured by Rheometrics).

The toner of the present invention described above shows excellent fixability over a wide temperature range including a low temperature range, and has high resistance to hot offset, and is further excellent in shelf stability, cleaning properties on a photosensitive member, printing durability and so on.

The colored particles can be produced by a conventional method such as a dry method (e.g. a pulverizing method or the like) or a wet method (e.g. a suspension polymerization method, an emulsion polymerization aggregation method, a dissolution suspension method, a phase inversion emulsion method or the like). Among these methods, a wet method is preferably used, and polymerization methods such as a suspension polymerization method, an emulsion polymerization aggregation method and so on are more preferably used.

Particularly, in the case of producing core-shell structured colored particle, a colored particle obtained by any one of the above methods may be used as a core layer, and the colored particle is covered with a shell layer by a conventional method such as a spray drying method, an interfacial reaction method, an in situ polymerization method, a phase separation method or the like.

Among these production methods, a polymerization method is preferably used for producing colored particle since a colored particle having an average circle degree of 1, that is, a colored particle having a shape close to a perfect sphere can be obtained. A core-shell structured colored particle is preferably produced by covering a colored particle produced by a polymerization method with a shell layer by an in situ polymerization method.

Hereinbelow, a method for producing core-shell structured colored particle, in which a colored particle as a core layer is produced by a polymerization method and the colored particle is covered with a shell layer by an in situ polymerization method, will be described.

First, a colored particle as a core layer is produced in the following manner. A colorant, a release agent, and if necessary, a charge control agent and/or other additives are dissolved or dispersed in a polymerizable monomer as a raw material of a binder resin to prepare a polymerizable monomer composition. Then, the polymerizable monomer composition is added to an aqueous dispersion medium containing a dispersion stabilizer to form droplets of the polymerizable monomer composition. A polymerization initiator is added to the dispersion liquid containing the droplets to carry out polymerization, and if necessary, resulting particles are agglomerated with each other, followed by filtration, washing, dewatering, and drying to obtain colored particle.

The polymerizable monomer as a raw material of a binder resin contains, as a main component, a monovinyl monomer, and if necessary, as a sub-component, a cross-linkable monomer, a cross-likable polymer, and other monomers. Such a polymerizable monomer is polymerized to be a binder resin component contained in the colored particle.

Examples of the monovinyl monomer include: aromatic vinyl monomers such as styrene, vinyl toluene, α-methyl styrene or the like; (meth)acrylic monomers such as (meth) acrylic acid, methyl(meth)acrylate, ethyl (meth)acrylate, propyl(meth)acrylate, butyl (meth)acrylate, 2-ethylhexyl(meth) acrylate, cyclohexyl (meth)acrylate, isobonyl(meth)acrylate, dimethylaminoethyl(meth)acrylate, (meth)acrylamide or the like; and monoolefin-based monomers such as ethylene, propylene, butylene or the like. It is to be noted that in the present invention, the term "(meth)acrylic" refers to either acrylic or methacrylic, and the term "(meth)acrylate" refers to either acrylate or methacrylate.

These monovinyl monomers can be used alone or in combination of two or more kinds. Among these monovinyl monomers, an aromatic vinyl monomer alone or a combination of an aromatic vinyl monomer and a (meth)acrylic monomer is suitably used.

By using the monovinyl monomer together with a cross-linkable monomer and a cross-linkable polymer, it is possible to effectively improve hot offset.

The cross-linkable monomer herein refers to a monomer having two or more polymerizable carbon-carbon unsaturated double bonds. Examples of such a monomer include: aromatic divinyl compounds such as divinylbenzene, divinylnaphthalene, and derivatives thereof; compounds having two vinyl groups in a molecule including di(meth)acrylic acid esters such as ethylene glycol dimethacrylate, diethylene glycol dimethacrylate or the like, divinyl ethers or the like; compounds having three or more vinyl groups in a molecule such as pentaerythritol triallyl ether, trimethylolpropane triacrylate or the like.

The cross-linkable polymer herein refers to a polymer having two or more vinyl groups. Specific examples of such a polymer include esters obtained by condensation between a polymer having two or more hydroxyl groups in a molecule (e.g. polyethylene, polypropylene, polyester, polyethylene glycol or the like) and an unsaturated carboxylic acid monomer (e.g. acrylic acid, methacrylic acid or the like).

The cross-linkable monomer and cross-linkable polymer can be used alone or in combination of two or more kinds. An amount thereof to be used is usually 10 parts by weight or less, preferably 0.1 to 2 parts by weight, with respect to 100 parts by weight of the monovinyl monomer.

As other monomers, a radically polymerizable epoxy compound or a radically polymerizable acid halide can be used to improve the dispersibility of the colorant, to prevent reaggregation of the colorant, and to control the dispersion of the release agent.

Examples of the radically polymerizable epoxy compound include glycidyl methacrylate, glycidyl acrylate, allyl glycidyl ether, styryl glycidyl ether, epoxy resins or the like.

Examples of the radically polymerizable acid halide include chloride compounds such as acryl chloride, methacryl chloride, styrene carbonyl chloride, styrene sulfonyl chloride, 2-methacryloyloxy ethyl succinyl chloride, 2-methacryloyloxy ethyl hexahydrophthalyl chloride or the like; and bromide compounds such as acryl bromide, methacryl bromide, styrene carbonyl bromide, styrene sulfonyl bromide, 2-methacryloyloxy ethyl succinyl bromide, 2-methacryloyloxy ethyl hexahydrophthalyl bromide or the like.

In the case of using such a radically polymerizable epoxy compound or acid halide, an amount thereof to be added to the polymerizable monomer used for forming a binder resin component is preferably in the range from 0.1 to 5 wt %, more preferably in the range from 0.2 to 3 wt %. If the amount of the radically polymerizable epoxy compound or acid halide is less than 0.1 wt %, the effect of dispersing a pigment may not be able to be satisfactorily obtained. If the amount of the radically polymerizable epoxy compound or acid halide contained exceeds 5 wt %, hot offset may occur. In either case, there is a possibility that image quality is lowered.

These radically polymerizable epoxy compounds and acid halides can be used alone or in combination of two or more kinds.

Examples of the dispersion stabilizer include well-known surfactants, inorganic dispersants, and organic dispersants. Among them, inorganic dispersants are preferably used as they can be easily removed by after treatment. Specific examples of the inorganic dispersant include: inorganic salts such as barium sulfate, calcium carbonate, calcium phosphate or the like; inorganic oxides such as silica, aluminum oxide, titanium oxide or the like; and inorganic hydroxides such as aluminum hydroxide, magnesium hydroxide, ferric hydroxide or the like. Among these dispersion stabilizers, those containing a colloid of a hardly water-soluble inorganic hydroxide are particularly preferably used since they can narrow the particle diameter distribution of the polymer particles, hardly remain after washing dispersion stabilizer, and contribute to reproduction of a sharp image.

The dispersion stabilizer is usually used in an amount from 0.1 to 20 parts by weight with respect to 100 parts by weight of the polymerizable monomer. By setting the amount of the dispersion stabilizer to a value within the above range, it is possible to carry out polymerization sufficiently stably while suppressing the aggregation of the polymer, and as a result a toner having a desired particle diameter can be obtained.

Examples of the polymerization initiator include: persulfates such as potassium persulfate, ammonium persulfate or the like; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile), dimethyl-2,2'-azobis(2-methylpropionate), 2,2'-azobisisobutyronitrile or the like; organic peroxides such as di-t-butyl peroxide, dicumyl peroxide, lauroyl peroxide, benzoyl peroxide, t-butylperoxy-2-ethylhexanoate, t-hexylperoxy-2-ethylhexanoate, t-butylperoxypivalate, di-isopropylperoxy dicarbonate, di-t-butylperoxy isophthalate, 1,1,3,3-tetramethylbutylperoxy-2-ethylhexanoate, t-butylperoxy isobutylate or the like; and redox initiators prepared by combining these polymerization initiators with reducing agents.

Among these polymerization initiators, an oil-soluble polymerization initiator which can be dissolved in the polymerizable monomer used is preferably used. If necessary, such a polymerization initiator may be used together with a water-soluble polymerization initiator.

The polymerization initiator is used in an amount from 0.1 to 20 parts by weight, preferably 0.3 to 15 parts by weight, more preferably 0.5 to 10 parts by weight, with respect to 100 parts by weight of the polymerizable monomer.

The polymerization initiator may be preliminarily added to the polymerizable monomer composition. However, in the case of suspension polymerization, the polymerization initiator may be directly added to a suspension obtained after the completion of the step of forming droplets of the polymerizable monomer composition, or in the case of emulsion polymerization, the polymerization initiator may be directly added to an emulsion obtained after the completion of the step of emulsification.

Further, at the time of polymerization, a molecular weight control agent is preferably added to a reaction system. Examples of the molecular weight control agent include: mercaptan compounds such as t-dodecylmercaptan, n-dodecylmercaptan, n-octylmercaptan, 2,2,4,6,6-pentamethylheptane-4-thiol or the like; and thiuram disulfide compounds such as tetramethylthiuram disulfide, tetraethylthiuram disulfide or the like. The molecular weight control agent is usually used in an amount from 0.01 to 10 parts by weight, preferably 0.1 to 5 parts by weight with respect to 100 parts by weight of the polymerizable monomer.

Next, the colored particle produced by the polymerization method described above can be covered with a shell layer in the following manner. In the case of covering with a shell layer by in situ polymerization, a polymerizable monomer for forming a shell layer (hereinafter, simply referred to as a "polymerizable monomer for shell") and a polymerization initiator for shell are added to an aqueous dispersion medium, in which the colored particle as a core layer is dispersed, to carry out polymerization, followed by filtration, washing, dewatering and drying to obtain a core-shell structured colored particle.

Specific examples of a method for forming a shell layer include: a method in which a polymerizable monomer for shell is added to a reaction system of the polymerization reaction performed to obtain a colored particle as a core layer to continuously perform polymerization; a method in which a colored particle obtained by polymerizing a polymerizable monomer, followed by association, filtration, washing, dewatering and drying is charged as a core layer into a reaction system different from that used for producing colored particle, and a polymerizable monomer for shell is added thereto to carry out polymerization stepwise; or the like.

Examples of the polymerizable monomer for shell include monomers such as styrene, acrylonitrile, methyl methacrylate or the like, capable of forming a polymer having a glass transition temperature higher than 80° C. The polymerizable monomer for shell may be preferably used alone or in combination of two or more kinds.

As the polymerization initiator for shell, a water-soluble polymerization initiator can be used. Examples of the water-soluble polymerization initiator include: persulfates such as potassium persulfate, ammonium persulfate or the like; azo-based initiators such as 2,2'-azobis(2-methyl-N-(2-hydroxyethyl)propionamide), 2,2'-azobis-(2-methyl-N-(1,1-bis (hydroxymethyl)2-hydroxyethyl)propionamide) or the like. The water-soluble polymerization initiator is usually used in an amount from 0.1 to 50 parts by weight, preferably 1 to 30 parts by weight, with respect to 100 parts by weight of the polymerizable monomer for shell.

The dispersion stabilizer contained in the aqueous dispersion of the colored particle obtained by polymerization is preferably removed by adding an acid or an alkali to the aqueous dispersion to dissolve the dispersion stabilizer in water. In a case where a colloid of a hardly water-soluble inorganic hydroxide is used as the dispersion stabilizer, an acid is preferably added to the aqueous dispersion to adjust the pH of the aqueous dispersion to 6.5 or less. Examples of the acid to be added include inorganic acids such as sulfuric acid, hydrochloric acid, nitric acid or the like; and organic acids such as formic acid, acetic acid or the like. Particularly, among these acids, sulfuric acid may be suitably used from the viewpoint of increasing the efficiency of removing the dispersion stabilizer and lightening the load on production facilities.

The colored particle, preferably the core-shell structured colored particle, obtained by the above-described method can be used directly as a toner for developing electrostatic image, but may further be mixed with an external additive, a carrier and/or other microparticles in a high-speed agitator such as HENSCHEL MIXER (trade name).

The characteristics of the toner produced by the above-described method, such as a dispersed diameter of the release agent and a loss tangent (tan δ) of the toner, are determined by interactions among the kinds and used amounts of the polymerizable monomer, the release agent and so on as well as polymerization temperature, polymerization time and so on.

The toner of the present invention can be widely used in electrophotography, electrostatic recording, electrostatic printing or the like for electrostatic latent image-developing systems, developing methods and image-forming apparatuses wherein electrostatic latent images are developed to form images such as photographs, pictures, text, symbols or the like. Particularly, the toner of the present invention is suitable for use in a heat-pressure fixing system, method and apparatus such as heat roller fixing or the like.

Hereinbelow, an image-forming method of the present invention will be described.

Figure 2:
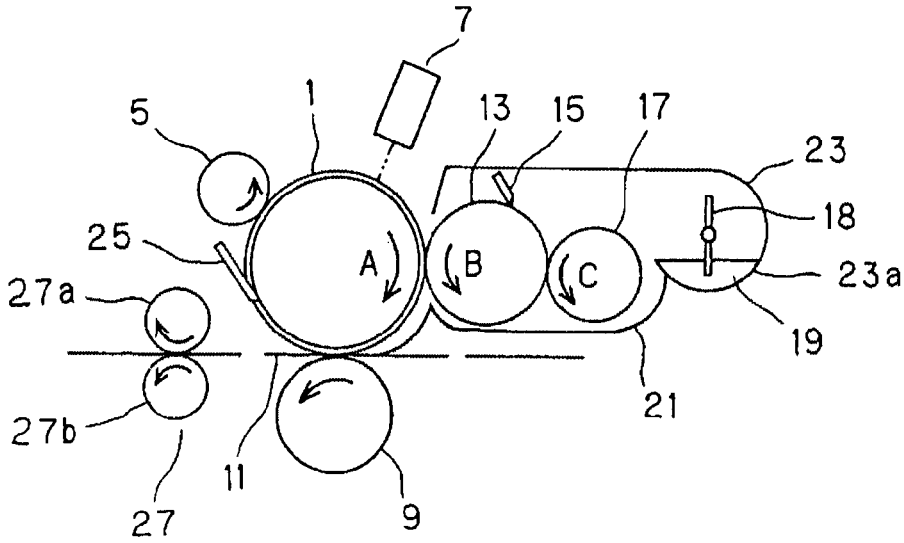
FIG. 2 is an illustration which shows one example of the structure of an image-forming apparatus using the toner for developing electrostatic image according to the present invention.

FIG. 2 shows one example of a structure of an image-forming apparatus using the toner for developing electrostatic latent image of the present invention. As shown in FIG. 2, the image-forming apparatus includes a photosensitive drum 1 as a photosensitive member, and the photosensitive drum 1 is provided so as to be rotatable in a direction indicated by the arrow A. The photosensitive drum 1 is obtained by providing a photoconductive layer on a conductive support drum. The photoconductive layer is formed from, for example, an organic photosensitive member, a selenium photosensitive member, a zinc oxide photosensitive member, an amorphous silicon photosensitive member or the like. Among these photosensitive members, the organic photosensitive member is preferable. The photoconductive layer may be bonded to the conductive support drum by the use of a resin. Examples of such a resin include polyester resins, acrylic resins, polycarbonate resins, phenol resins, epoxy resins or the like. Among them, the polycarbonate resins are preferable.

Around the photosensitive drum 1, there are provided, along the circumferential direction thereof, a charging roller 5 as a charging member, a light irradiation device 7 as an exposure device, a developing device 21, a transfer roller 9 and a cleaning blade 25.

On the downstream side of the photosensitive drum 1 in a conveying direction, there is provided a fixing device 27. The fixing device 27 includes a heat roller 27*a* and a support roller 27*b*.

A path for conveying a recording medium is provided so that a recording medium can pass between the photosensitive drum 1 and the transfer roller 9 and then between the heat roller 27*a* and the support roller 27*b*.

The process for forming image with the image-forming apparatus shown in FIG. 2 includes a charging step, an exposure step, a developing step, a transfer step, a cleaning step, and a fixing step. These steps will be described in detail below.

The charging step is carried out to allow the surface of the photosensitive drum 1 to be uniformly positively or negatively charged using a charging member. As a charging method using the charging member, there are a contact charging method using, for example, the charging roller 5 shown in FIG. 2, a fur brush, a magnetic brush, a blade or the like, and a non-contact charging method using corona discharge. The charging method using the charging roller 5 can be replaced with such a contact charging method or a non-contact charging method.

The exposure step is carried out to form an electrostatic latent image on the surface of the photosensitive drum 1 uniformly charged. The electrostatic latent image is formed by irradiating the surface of the photosensitive drum 1 with light emitted from the light irradiation device 7 shown in FIG. 2 as an exposure device and corresponding to image signals. The light irradiation device 7 includes, for example, an irradiation device and an optical lens. Examples of the irradiation device include a laser beam irradiation device and an LED irradiation device.

The developing step is carried out by the developing device 21 to attach the toner to the electrostatic latent image formed on the surface of the photosensitive drum 1 in the exposure step. The charge polarity of the toner is selected so that the toner can be attached only to a light-radiated part in reversal development, or only to a light-non-radiated part in normal development.

The developing device 21 of the image-forming apparatus shown in FIG. 2 is designed for use in mono-component contact development. In a casing 23 for receiving the toner 19, there are provided a stirring vane 18, a developing roller 13 and a supply roller 17.

The developing roller 13 is provided so as to be partially brought into contact with the photosensitive drum 1 and to be rotatable in the direction B opposite to the rotating direction of the photosensitive drum 1. The supply roller 17 is in contact with the developing roller 13, and rotates in the same direction C as the developing roller 13 so that the toner 19 charged by the stirring vane 18 in a toner vessel 23*a* and then attached to the outer periphery of the developing roller 17 is fed to the outer periphery of the developing roller 17. As developing methods other than such a mono-component contact developing method, there are known a mono-component non-contact developing method, a two-component contact developing method, and a two-component non-contact developing method.

At a position between the contact point between the developing roller 13 and the supply roller 17 and the contact point between the developing roller 13 and the photosensitive drum 1, there is provided, as a member for regulating the thickness of a toner layer, a blade 15 for the developing roller on the periphery of the developing roller 13. The blade 15 for the developing roller is composed of, for example, a conductive rubber elastic member or a metal.

The transfer step is carried out to transfer a toner image formed on the surface of the photosensitive drum 1 by the developing device 21 onto a recording medium 11 such as paper. Transfer is usually carried out using a transfer roller such as the transfer roller 9 shown in FIG. 2, but belt transfer or corona transfer may also be carried out.

The cleaning step is carried out to clean up the toner remaining on the surface of the photosensitive drum 1. In the case of the image-forming apparatus shown in FIG. 2, a cleaning blade 25 is used. The cleaning blade 25 may be composed of a rubber elastic member made of, for example, polyurethane, an acrylonitrile-butadiene copolymer or the like.

In the image-forming apparatus shown in FIG. 2, the entire surface of the photosensitive drum 1 is uniformly negatively charged by the charging roller 5, and then an electrostatic latent image is formed by the light irradiation device 7, and then a toner image is formed by the developing device 21. The thus formed toner image on the photosensitive drum 1 is transferred onto a recording medium such as paper, an OHP sheet, another transparent film or the like by the transfer roller 9. The toner not transferred but remaining on the surface of the photosensitive drum 1 is cleaned up by the cleaning blade 25. Then, the next image-forming cycle is started.

The fixing step is carried out to fix the toner image transferred onto the recording medium 11. In the image-forming apparatus shown in FIG. 2, at least one of the heat roller 27*a* heated by a heating means (not shown) and the support roller 27*b* is rotated, and therefore the recording medium 11 is heated and pressed when passing between the heat roller 27*a* and the support roller 27*b*.

The image-forming apparatus shown in FIG. 2 is designed as a monochrome image-forming apparatus, but the toner of the present invention can also be used in color image-forming apparatuses such as color copying machines and color printers.

EXAMPLES

Hereinbelow, the present invention will be described in more detail with reference to the following examples. It goes without saying that the scope of the present invention is not limited to these examples. It is to be noted that in the following examples, the terms "part(s)" and "%" refer to "part(s) by weight" and "% by weight", respectively, unless otherwise specified.

[Evaluation Methods]

Toners of the following examples and comparative examples were evaluated by the methods described below.

<Measurement of Physical Properties of Toner>

(1) Shape Factor (SF-1, SF-2)

The toner was photographed using an FE-SEM (field emission-type scanning electron microscope, product name: S-4700; manufactured by Hitachi, Ltd.), and then 1000 colored particles were randomly sampled in the micrograph. The image information of these colored particles was analyzed by an image analyzer (product name: Luzex3; manufactured by NIRECO Corporation) to obtain values of SF-1 and SF-2.

(2) Viscoelasticity of Toner

The dynamic viscoelasticity of the toner was measured using a dynamic viscoelasticity measuring instrument (rheometer) (product name: RDA-II; manufactured by Rheometrics) at different temperatures while the temperature of the toner was increased at a constant frequency to calculate loss tangents (tan δ).

Measurement conditions are as follows.

<Measurement Conditions>

Measurement tool: A parallel plate having a diameter of 7.9 mm was used for a high-elastic modulus sample and a parallel plate having a diameter of 25 mm was used for a low-elastic modulus sample.

Sample to be measured: A toner molded into a disk-shaped sample having a diameter of about 25 mm and a thickness from 2 to 3 mm Measurement frequency: 6.28 radian/sec Measurement strain: Initially set to 0.1%.

Correction for sample elongation: Adjusted by an automatic measurement mode.

Measurement temperature: Increased at a rate of 1° C./min from 30 to 200° C.

(3) Observation of Release Agent in Cross-Section of Toner

The toner was dispersed in an epoxy resin, cured, cooled to a temperature of −80° C., and cut with a microtome to prepare a thin slice. The thin slice was stained with a vapor of 0.5% aqueous solution of ruthenium tetroxide for about 5 minutes, and then the stained thin slice was observed with a TEM (transmission electron microscope) (product name: JEM-2500SE; manufactured by JEOL) (magnification: ×5,000 to ×6,000).

The concentration of the toner in a sample obtained by dispersing the toner in an epoxy resin was adjusted so that 5 to 10 cross-sections of the colored particles was observed in a TEM image covering an area of 28×35 μm. Among the colored particles observed in the TEM image covering an area of 28×35 μm, one whose cross-section was not entirely shown and one whose cross-sectional size was not 0.6 to 1.2 times the volume average particle diameter of the colored particle were excluded from evaluation. The cross-sections of the colored particles other than such colored particles excluded from evaluation were observed on the TEM screen to determine the diameters of island-shaped separate phases of the release agent. The average diameter of the island-shaped separate phases was defined as a dispersed diameter of the release agent.

(4) Shelf Stability of Toner 20 g of the toner was charged into a container, and then the container was sealed, and was then immersed in a constant temperature water bath maintained at 55° C. The container was taken out of the bath after the lapse of 8 hours. The toner was transferred from the container onto a 42-mesh sieve so as not to be shaken as much as possible. The sieve was vibrated for 30 seconds using a powder measuring instrument (product name: POWDER TESTER; manufactured by Hosokawa Micron Corporation) at a vibration velocity of 1.0 mm/sec. Then, the weight of the toner remaining on the sieve was measured, and was defined as the weight of the aggregated toner.

The ratio (% by weight) of the weight of the aggregated toner to the total weight of the toner initially sampled was calculated and used as a criterion to evaluate the shelf stability of the toner. A smaller value of this ratio (% by weight) means that the amount of the toner aggregated is smaller, that is, the toner has better shelf stability. The ratio is preferably 1.5% by weight or less, more preferably 1% by weight or less.

<Test for Image Quality>

(5) Minimum Fixing Temperature and Hot Offset Temperature of Toner

A commercially available non-magnetic mono-component development type printer (printing speed: 20 A4 sheets of paper per minute) was modified so that the temperature of a fixing roller unit was variable. A fixing test was carried out using such a modified printer to measure the fixing rate of the toner at different temperatures of the fixing roller to determine the relationship between the temperature of the fixing roller and the fixing rate of the toner.

The fixing rate of the toner was defined as a ratio between image densities before and after a tape peeling operation performed on a solid pattern printing area (i.e. an area having an printing density of 100%) printed on a test sheet of paper by the printer. More specifically, when the printing density before the peeling-off of a tape is defined as ID (before) and the printing density after the peeling-off of a tape is defined as ID (after), the fixing rate can be calculated from the following formula:

$$\text{Fixing rate}(\%)=(\text{ID(after)}/\text{ID(before)})\times 100$$

Here, the tape peeling operation means a series of operation in which a pressure-sensitive adhesive tape (product name: Scotch Mending Tape 810-3-18; manufactured by Sumitomo 3M Limited) is attached to an area to be measured (i.e. a solid pattern printing area) on a test sheet of paper, pressed at a constant pressure to be adhered to the sheet, and peeled off from the test sheet in a direction along the test sheet (i.e. in a direction horizontal to the test sheet) at a constant rate.

The printing density was measured using a reflection image densitometer (product name: RD-914; manufactured by Mcbeth Co.). In this fixing test, the lowest temperature of the fixing roller at which the fixing rate was 80% or higher was defined as the minimum fixing temperature of the toner.

A temperature at which a residual adherent caused by hot offset was observed on the fixing roller whose temperature was increased by 10° C. was defined as a hot offset temperature.

(6) Durability (Fog on Photosensitive Member)

Sheets of paper for printing were fed into the modified printer used in the above (5), and the toner was charged into a developing device of the printer. The printer was left in an N/N environment (temperature: 23° C., humidity: 50%) all day long. Then, continuous printing was carried out using the printer at a printing density of 5%, and a printing density and a fog value were measured after printing of every 1,000 sheets.

The printing density was measured in the following manner. Solid pattern printing (i.e. printing at a printing density of 100%) was performed on a sheet of paper, and the printing density of the sheet of paper was measured using a reflection image densitometer (product name: RD-914; manufactured by Macbeth Co.). It is to be noted that in the present invention the term "solid pattern printing" means printing at a printing density of 100%.

The fog value was measured in the following manner. During plain pattern printing (i.e. printing at a printing density of 0%), the operation of the printer was suspended after development. Then, a pressure-sensitive adhesive tape (product name: Scotch Mending Tape 810-3-18; manufactured by Sumitomo 3M Limited) was attached to the photosensitive member to adhere the toner on a non-image part to the tape. The pressure-sensitive adhesive tape was then attached to an unused sheet of paper for printing to measure the color tone thereof using a spectral colorimeter (product name: SE-2000; manufactured by Nippon Denshoku Kogyo K.K.). As a control (i.e. a standard sample), an unused pressure-sensitive adhesive tape was attached to a sheet of paper for printing to measure the color tone thereof in the same manner as described above. These color tones were expressed as coordinates on an L×a×b space, a color difference ΔE was calculated from the color tones of the sample to be measured and the standard sample, and was defined as a fog value. A smaller fog value means less fog, that is, higher image quality. It is to be noted that in the present invention, the term "plain pattern printing" means printing at a printing density of 0%, that is, plain white printing.

A durability test was carried out in the following manner. Printing was continuously performed so long as a printing density as measured when solid pattern printing was performed was 1.3 or higher and the fog value as measured when plain pattern printing was performed was 1% or less, and was stopped when the number of sheets of paper reached 15,000. In the test results, "15,000<" means that the above requirements were satisfied when continuous printing of 15,000 sheets of paper was completed.

(7) Cleaning Property

Continuous printing of 15,000 sheets of paper was performed in the same manner as in the above (6), and the photosensitive member and a charging roller were visually observed after printing of every 1,000 sheets of paper to see whether or not the toner escaped a cleaning blade to cause poor cleaning. The cleaning property of the toner was evaluated by the number of sheets of paper printed until poor cleaning was observed (hereinafter, referred to as the "number of sheets printed until poor cleaning occurs")

(8) Filming Resistance

Continuous printing of 15,000 sheets of paper was performed in the same manner as in the above (6), and the photosensitive member was visually observed after printing of every 1,000 sheets of paper to see whether or not filming occurred on the photosensitive member. The filming resistance of the toner was evaluated by the number of sheets of paper printed until filming was observed (hereinafter, referred to as the "number of sheets printed until filming occurs").

[Synthesis of Negative Charge Control Resin]

Production Example 1

Synthesis of Negative Charge Control Resin 1

85 parts of styrene, 13 parts of n-butyl acrylate, and 2 parts of 2-acrylamide-2-methylpropanesulfonic acid were added to 900 parts of toluene, and they were reacted in the presence of 4 parts of azobisdimethyl valeronitrile at 80° C. for 8 hours. After the completion of the reaction, toluene was removed by distillation under a reduced pressure to obtain a sulfonic acid group-containing copolymer. The weight average molecular weight (Mw) of the sulfonic acid group-containing copolymer was 22,000. The thus obtained sulfonic acid group-containing copolymer is hereinafter referred to as a negative charge control resin 1. The amount of a functional group-containing structural unit contained in the negative charge control resin 1 was 2% by weight.

Production Example 2

Synthesis of Viscoelasticity Control Resin 1

100 parts of an isobornyl acrylate monomer was charged into 900 parts of toluene, and they were heated to 80° C. and reacted for 8 hours in the presence of 4 parts of azobisdimethyl valeronitrile as a polymerization initiator. After the completion of the reaction, toluene was removed by distillation under a reduced pressure to obtain an isobornyl acrylate polymer (hereinafter, referred to as a "viscoelasticity control resin 1"). The weight average molecular weight (Mw) and Tg of the polymer were 22,000 and 94° C., respectively.

Production Example 3

Synthesis of Viscoelasticity Control Resin 2

100 parts of a t-butyl methacrylate monomer was charged into 900 parts of toluene, and they were heated to 80° C. and reacted for 8 hours in the presence of 4 parts of azobisdimethyl valeronitrile as a polymerization initiator. After the completion of the reaction, toluene was removed by distillation under a reduced pressure to obtain a t-butyl methacrylate polymer (hereinafter, referred to as a "viscoelasticity control resin 2"). The weight average molecular weight (Mw) and Tg of the polymer were 19,000 and 107° C., respectively.

EXAMPLE

Example 1

80.5 parts of styrene (ST), 19.0 parts of n-butyl acrylate (BA), 0.5 part of divinylbenzene (DVB), 0.5 part of glycidyl methacrylate (GMA), 1.5 parts of t-dodecylmercaptan (TDM), 5 parts of the isobornyl acrylate polymer (viscoelasticity control resin 1) obtained in the Production example 2, and 6 parts of C.I. Pigment Blue 15:3 (manufactured by Clariant K.K.) as a cyan pigment (cyan colorant) were charged into a media type wet grinding machine (product name: PICO MILL; manufactured by Asada Iron Works Co., Ltd.) to perform wet grinding, and then 5 parts of the negative charge control resin obtained in Production example 1 and 5 parts of dipentaerythritol hexamyristate (DPEHM) (product name: W663; manufactured by NOF Corporation) as a release agent were added and mixed until dissolved to obtain a polymerizable monomer composition.

On the other hand, 11.8 parts of magnesium chloride was dissolved in 250 parts of ion-exchanged water to prepare an aqueous solution of magnesium chloride, and then an aqueous solution prepared by dissolving 6.6 parts of sodium hydroxide in 50 parts of ion-exchanged water was added little by little to the aqueous solution of magnesium chloride under stirring to prepare an aqueous dispersion containing a magnesium hydroxide colloid (i.e. a hardly water-soluble metal hydroxide colloid) as a dispersion stabilizer.

Further, 1 part of methyl methacrylate (i.e. a polymerizable monomer for shell) was mixed with 65 parts of ion-exchanged water, and the mixture was subject to finely-dispersing treatment using an ultrasonic emulsifier to obtain an aqueous dispersion of a polymerizable monomer for shell.

The polymerizable monomer composition was added to the magnesium hydroxide colloidal dispersion, and the resulting mixture was stirred. Then, 6 parts of t-butyl peroxyisobutyrate (product name: PERBUTYL IB; manufactured by NFO Corporation) was further added thereto as a polymerization initiator, and the resulting mixture was highly sheared and stirred at 15,000 rpm for 30 minutes using an inline type emulsifier (product name: EBARA MILDER; manufactured by Ebara Corporation) to form droplets of the polymerizable monomer composition.

The aqueous dispersion having the droplet of the polymerizable monomer composition dispersed therein was charged into a reaction vessel equipped with a stirring vane, and was heated to 95° C. After the lapse of about 40 minutes, the aqueous dispersion was cooled to 40° C., and was then again highly sheared and stirred at 18,000 rpm for 5 minutes using the inline type emulsifier to subject the droplets to ovalization. Thereafter, the aqueous dispersion was again heated to 95° C.

After a polymerization conversion rate reached almost 100%, a solution prepared by dissolving, in the aqueous dispersion of the polymerizable monomer for shell, 0.5 part of 2,2'-azobis[2-methyl-N-(2-hydroxyethyl)-propionamide] (product name: VA-086; manufactured by Wako Pure Chemical Industries, Ltd.) as a polymerization initiator for the polymerizable monomer for shell was charged into the reaction vessel. Polymerization reaction was continued for 4 hours, and was stopped by cooling the reaction vessel in water to obtain an aqueous dispersion of colored particles.

It is to be noted that the polymerization conversion rate was determined in the following manner and calculated by the following equation.

About 2 g of the aqueous dispersion having the droplets of the polymerizable monomer composition dispersed therein was sampled from the reaction vessel in the course of polymerization, placed in an aluminum plate, and precisely weighed. Then, 2 mL of a 5% ethanol solution of hydroquinone was added as a polymerization inhibitor thereto, and the resulting mixture was heated at 150° C. for about 20 minutes in an oven to evaporate moisture and volatile components, and was then cooled to room temperature. The weight of solid matter remaining on the aluminum plate was precisely weighed.

$$\text{Polymerization conversion rate}(\%)=\{(\text{weight of solid matter remaining on aluminum plate after heating})/(\text{weight of droplets contained in aqueous dispersion sampled})\}\times 100$$

The thus obtained aqueous dispersion of colored particles was adjusted to pH 6.0 by adding 10% dilute sulfuric acid under stirring at room temperature to dissolve magnesium hydroxide, and was then filtered and dewatered. Then, 250 parts of ion-exchanged water having a temperature of 40° C. was added thereto to obtain an aqueous dispersion, and was again filtered and dewatered. Then, 250 parts of methanol was added thereto, stirred for 1 hour, filtered and dewatered. Thus obtained colored particles were dried. In this way, a colored particle having a volume average particle diameter of 6.7 μm was obtained.

To 100 parts of the obtained colored particles, 1 part of silica fine particles whose number average particle diameter of primary particles was 12 nm (product name: R-104; manufactured by Nippon Aerosil) and 0.5 part of silica fine particles whose number average particle diameter of primary particles was 50 nm (product name: HDK-H05TX; manufactured by Clariant K.K.) were added, and the resulting mixture was stirred at 1,400 rpm for 10 minutes using HENSCHEL MIXER (trade name) to prepare a toner.

Example 2

A toner was prepared in the same manner as in the Example 1 except that the ratio of amounts of styrene, n-butyl acrylate and divinylbenzene (ST/BA/DVB) charged was changed to 80/19/1 and that 0.5 part of GMA was replaced with 0.5 part of 3,4-epoxycyclohexylmethyl methacrylate (CHMM).

Example 3

A toner was prepared in the same manner as in the Example 1 except that the ratio of amounts of styrene, n-butyl acrylate and divinylbenzene (ST/BA/DVB) charged was changed to 79/19/2, the amount of TDM was changed from 1.5 parts to 2.0 parts, 0.5 part of GMA was replaced with 0.5 part of vinylcyclohexene monoxide-1,2-epoxy-4-vinyl cyclohexane (VCH), and 5 parts of the isobornyl acrylate polymer (i.e. the viscoelasticity control resin 1) obtained in the Production example 2 was replaced with 5 parts of a t-butyl methacrylate polymer (i.e. the viscoelasticity control resin 2 obtained in the Production example 3).

Comparative Example 1

A toner was prepared in the same manner as in the Example 1 except that the ratio of amounts of styrene, n-butyl acrylate and divinylbenzene (ST/BA/DVB) charged was changed to 90/10/0.2, 0.5 part of GMA was replaced with 0.5 part of a MMA macromonomer (MMAMM) (product name: AA-6; manufactured by TOAGASEI Co., Ltd.), the amount of DPEHM was changed to 10 parts, and the amount of the isobornyl acrylate polymer (i.e. the viscoelasticity control resin 1) was changed to 2 parts.

Comparative Example 2

A toner was prepared in the same manner as in the Example 1 except that the ratio of amounts of styrene, n-butyl acrylate and divinylbenzene (ST/BA/DVB) charged was changed to 90/10/0.2, 0.5 part of GMA was replaced with 0.5 part of MMAMM, 5 parts of DPEHM was replaced with 2 parts of polyethylene wax (product name: LUVAX-1151; manufactured by Nippon Seiro Co., Ltd.), and the amount of the isobornyl acrylate polymer (i.e. the viscoelasticity control resin 1) was changed to 2 parts.

Comparative Example 3

A toner was prepared in the same manner as in the Example 1 except that the ratio of amounts of styrene, n-butyl acrylate and divinylbenzene (ST/BA/DVB) charged was changed to 90/10/0.2, 0.5 part of GMA was replaced with 1.5 parts of MMAMM, 5 parts of DPEHM was replaced with 2 parts of polyethylene wax (product name: LUVAX-1151; manufactured by Nippon Seiro Co., Ltd.), and the isobornyl acrylate polymer (i.e. the viscoelasticity control resin 1) was not used.

[Results]

The properties of the toners obtained in the above Examples and Comparative examples and the images formed from these toners were evaluated by the methods described above. The evaluation results are shown in table 1.

It is to be noted that abbreviations shown in Table 1 are as follows.

*1: Abbreviations for binder resins and polymerizable monomers for shell: ST (styrene), BA (butyl acrylate), DVB (divinylbenzene), MMA (methyl methacrylate), CHMM (3,4-epoxycyclohexylmethyl methacrylate), VCH (vinylcyclohexene monoxide-1,2-epoxy-4-vinylcyclohexane), and MMAMM (MMA macromonomer).

*2: Abbreviations for release agents: DPEHM (dipentaerythritol hexamyristate), and LUVAX (polyethylene wax).

*3: Abbreviations for viscoelasticity control resins: PIBA (isobornyl acrylate polymer obtained in the Production example 2, Tg: 94° C.), and t-BMA (t-butyl methacrylate polymer obtained in the Production example 3, Tg: 107° C.).

TABLE 1

| | Example 1 | Example 2 | Example 3 | Comparative Example 1 | Comparative Example 2 | Comparative Example 3 |
|---|---|---|---|---|---|---|
| Binder resin (weight ratio of feed amount)*1 | ST/BA/DVB (80.5/19.0/0.5) | ST/BA/DVB (80/19/1) | ST/BA/DVB (79/19/2) | ST/BA/DVB (90/10/0.2) | ST/BA/DVB (90/10/0.2) | ST/BA/DVB (90/10/0.2) |
| Monomer added to binder resin | GMA (0.5 parts) | CHMM (0.5 parts) | VCH (0.5 parts) | MMAMM (0.5 parts) | MMAMM (0.5 parts) | MMAMM (1.5 parts) |
| Release agent (feed amount)*2 | DPEHM (5 parts) | DPEHM (5 parts) | DPEHM (5 parts) | DPEHM (10 parts) | LUVAX (2 parts) | LUVAX (2 parts) |
| Added resin (feed amount)*3 | PIBA (5 parts) | PIBA (5 parts) | t-BMA (5 parts) | PIBA (2 parts) | PIBA (2 parts) | — |
| Chain transfer agent (feed amount) | TDM (1.5 parts) | TDM (1.5 parts) | TDM (2.0 parts) | TDM (1.5 parts) | TDM (1.5 parts) | TDM (1.5 parts) |
| Number of peaks or shoulders of tan δ | 2 (61° C., 85° C.) | 2 (62° C., 80° C.) | 2 (68° C., 90° C.) | 2 54° C., 79° C.) | 2 (55° C., 84° C.) | 1 (52° C.) |
| Tan δ (maximum value in the range from 100 to 200° C.) | 0.71 | 0.68 | 0.76 | 0.76 | 1.1 | 0.8 |
| Tan δ (minimum value in the range from 100 to 200° C.) | 0.35 | 0.28 | 0.39 | 0.25 | 0.35 | 0.41 |
| Tan δ (200° C.)/Tan δ (150° C.) | 1.35 | 1.26 | 1.41 | 1.2 | 1.24 | 0.9 |
| Presence or absence of release agent having dispersed diameter larger than 0.1 times the Dv of colored particle | Absent | Absent | Absent | Present | Absent | Absent |
| SF-1 | 150 | 155 | 148 | 115 | 136 | 170 |
| Sf-2 | 128 | 130 | 131 | 113 | 128 | 155 |
| Minimum fixing temperature | 120° C. | 120° C. | 120° C. | 140° C. | 130° C. | 140° C. |
| Hot offset temperature | 200° C. | 200° C. | 190° C. | 200° C. | 170° C. | 200° C. |
| Durability (fog on photosensitive member) | 15,000< | 15,000< | 14,000 | 15,000 | 15,000< | 14,000 |
| Number of sheets printed until poor cleaning occurs | 15,000< | 15,000< | 15,000< | 10,000 | 15,000 | 15,000< |
| Number of sheets printed until filming occurs | 15,000< | 15,000< | 14,000 | 8,000 | 10,000 | 10,000 |
| Shelf stability | 0.5 wt % | 0.4 wt % | 1.2 wt % | 3.5 wt % | 2.2 wt % | 0.3 wt % |
| Volume average particle diameter of colored particle(μm) | 6.2 | 6.3 | 6.1 | 6.1 | 6.2 | 6.0 |
| Dispersed diameter of release agent (μm) | 0.15 | 0.32 | 0.29 | 1.5 | 0.51 | 0.44 |

[Summary of Evaluation Results]

The toners obtained in Examples 1 to 3 had two maximum values of peaks or shoulders of loss tangent (tan δ) in the range from 50 to 120° C., a loss tangent (tan δ) in the range from 100 to 200° C. of 0.8 or less, and a ratio between a loss tangent at 150° C. (i.e. tan δ (150° C.)) and a loss tangent at 200° C. (i.e. tan δ (200° C.)) (tan δ (200° C.)/tan δ (150° C.)) of 1.2 or more. In addition, the dispersed diameter of the release agent contained in each of the toners is 0.1 times or less shorter than the volume average particle diameter of the colored particle contained in the toner, and the shape factors SF-1 and SF-2 of the colored particle are 130≦SF-1≦170 and 110≦SF-2≦150, respectively.

These toners of Examples 1 to 3 had a low minimum fixing temperature and a high hot offset temperature, and were excellent in printing durability, cleaning properties, filming resistance and shelf stability.

On the other hand, the toner obtained in Comparative example 1 had a large dispersed diameter of the release agent contained in the colored particle, and a small SF-1. The toner of Comparative example 1 was excellent in a hot offset temperature as measured in the image quality test, but the minimum fixing temperature thereof was high. In addition, the toner of Comparative example 1 was inferior to the toners of the Examples 1 to 3 in all the printing durability, the number of sheets printed until poor cleaning occurs, the number of sheets printed until filming occurs and shelf stability, particularly in the number of sheets printed until poor cleaning occurs, the number of sheets printed until filming occurs and shelf stability.

The toner obtained in Comparative example 2 had a loss tangent (tan δ) in the range from 100 to 200° C. of larger than 0.8. In addition, the toner of Comparative example 2 had a high minimum fixing temperature and a lower hot offset temperature as measured in the image quality test than the toners of Examples 1 to 3, and was inferior to the toners of Examples 1 to 3 in the number of sheets printed until poor cleaning occurs, the number of sheets printed until filming occurs and shelf stability.

The toner obtained in Comparative example 3 had only one peak or shoulder of loss tangent (tan δ) in the range from 50 to 120° C., and a ratio between a loss tangent at 150° C. (tan δ (150° C.)) and a loss tangent at 200° C. (tan δ (200° C.)) (i.e. tan δ (200° C.)/tan δ (150° C.)) of less than 1.2. The toner of Comparative example 3 was excellent in hot offset temperature and shelf stability, but had a high minimum fixing temperature as measured in the image quality test. In addition, the toner of Comparative example 3 was inferior to the toners of Examples 1 to 3 in printing durability and the number of sheets printed until filming occurs, particularly in the number of sheets printed until filming occurs.

INDUSTRIAL APPLICABILITY

The toner for developing electrostatic image of the present invention can be widely used in electrophotography, electrostatic recording, electrostatic printing, magnetic recording or the like for electrostatic latent image-developing systems, developing methods and image-forming apparatuses for developing latent images having electrostatic properties, such as an electrostatic latent image, a magnetic latent image or the like, to form images such as photographs, pictures, text, symbols or the like. Particularly, the toner of the present invention is suitable for use in a heat-pressure fixing system, method and apparatus such as heat roller fixing or the like.

The invention claimed is:

1. A toner for developing electrostatic image comprising a colored particle containing a colorant, a binder resin and a release agent, wherein the toner for developing electrostatic image has two or more peaks of loss tangent (tan δ) in the range from 50° C. to 120° C., a loss tangent tan δ in the range from 100° C. to 120° C. is 0.8 or less, and a dispersed diameter of the release agent is 0.1 times or less shorter than a volume average particle diameter of the colored particle.

2. The toner for developing electrostatic image according to claim 1, wherein a ratio of a loss tangent at 150° C. (tan δ (150° C.)) and a loss tangent at 200° C. (tan δ (200° C.)) of the toner for developing electrostatic image "tan δ (200° C.)./tan δ (150° C.)." is 1.2 or more.

3. The toner for developing electrostatic image according to claim 1, wherein shape factors SF-1 and SF-2 of the colored particle in the toner for developing electrostatic image are $130 \leqq SF\text{-}1 \leqq 170$ and $110 \leqq SF\text{-}2 \leqq 150$.

4. The toner for developing electrostatic image according to claim 1, wherein the toner for developing electrostatic image is produced by a polymerization method.

5. The toner for developing electrostatic image according to claim 1, wherein a volume average particle diameter (Dv) of the colored particle is in the range from 4 to 10 μm.

6. The toner for developing electrostatic image according to claim 1, wherein the release agent is a multifunctional ester compound.

7. An image forming method comprising steps of: a developing process to form a visible image with the toner for developing electrostatic image defined by claim 1 on a photosensitive member, a transferring process to form a transferred image by transferring the visible image on a recording medium, and a fixing process to fix the transferred image on the recorded medium.

8. The toner for developing electrostatic image according to claim 1, wherein the toner for developing electrostatic image has two peaks of loss tangent (tan δ) in the range from 50° C. to 120° C.

* * * * *